US008441494B2

(12) United States Patent
Byford et al.

(10) Patent No.: US 8,441,494 B2
(45) Date of Patent: May 14, 2013

(54) METHOD AND SYSTEM FOR COPYING A FRAMEBUFFER FOR TRANSMISSION TO A REMOTE DISPLAY

(75) Inventors: Dustin Byford, Pacifica, CA (US); Anthony Cannon, Cupertino, CA (US); Ramesh Dharan, San Francisco, CA (US)

(73) Assignee: VMware, Inc., Palo Alto, CA (US)

( * ) Notice: Subject to any disclaimer, the term of this patent is extended or adjusted under 35 U.S.C. 154(b) by 904 days.

(21) Appl. No.: 12/428,971

(22) Filed: Apr. 23, 2009

(65) Prior Publication Data

US 2010/0271379 A1 Oct. 28, 2010

(51) Int. Cl.
*G09G 5/36* (2006.01)
*G09G 5/399* (2006.01)

(52) U.S. Cl.
USPC ..... 345/545; 345/539; 345/548

(58) Field of Classification Search ..... 345/545, 345/548, 539, 555
See application file for complete search history.

(56) References Cited

U.S. PATENT DOCUMENTS

| | | | | |
|---|---|---|---|---|
| 5,600,763 | A * | 2/1997 | Greene et al. | 345/420 |
| 6,343,313 | B1 * | 1/2002 | Salesky et al. | 709/204 |
| 6,452,579 | B1 | 9/2002 | Itoh et al. | |
| 7,447,997 | B2 | 11/2008 | Colle | |
| 1,003,121 | A1 | 2/2011 | Kim et al. | |
| 7,899,864 | B2 * | 3/2011 | Margulis | 709/204 |
| 2003/0142111 | A1 * | 7/2003 | Emerson et al. | 345/600 |
| 2006/0282855 | A1 | 12/2006 | Margulis | |
| 2008/0105650 | A1 | 5/2008 | Sugai et al. | |
| 2009/0028761 | A1 | 1/2009 | Devine et al. | |
| 2009/0206056 | A1 | 8/2009 | Xu et al. | |

FOREIGN PATENT DOCUMENTS

| | | | |
|---|---|---|---|
| KR | 20080018396 | | 2/2008 |
| WO | 0065464 | A1 | 11/2000 |
| WO | 2007057053 | A1 | 5/2007 |

OTHER PUBLICATIONS

European Patent Office, European Search Report and European Search Opinion dated Apr. 28, 2011.
First Notice of Preliminary Rejection issued on May 29, 2011 by Korean Intellectual Property Office (English translation provided),.
IP Australia, Application 2010201050, Office Action dated Jan. 28, 2011.
PCT international search report and written opinion of PCT/US2012/027099 dated Sep. 25, 2012.

* cited by examiner

*Primary Examiner* — Hau Nguyen
(74) *Attorney, Agent, or Firm* — Daniel Lin; Leonard Heyman

(57) ABSTRACT

Remote desktop servers include a display encoder that maintains a secondary framebuffer that contains display data to be encoded and transmitted to a remote client display. The display encoder submits requests to update the display data in the secondary framebuffer to a video adapter driver that has access to a primary framebuffer whose display data is updated according to drawing commands received from applications running on the remote desktop servers. The video adapter driver utilizes a spatial data structure to track changes made to the display data located in regions of the primary framebuffer and copies the display data in those regions of the primary framebuffer to corresponding regions in the secondary framebuffer.

20 Claims, 7 Drawing Sheets

METHOD AND SYSTEM FOR COPYING A FRAMEBUFFER FOR TRANSMISSION TO A REMOTE DISPLAY

CROSS-REFERENCE TO RELATED APPLICATIONS

The present application is related to U.S. patent application entitled "Method and System for Identifying Drawing Primitives for Selective Transmission to a Remote Display" Ser. No. 12/428,949 and filed on the same day as the present application, which is hereby incorporated by reference.

BACKGROUND

Current operating systems typically include a graphical drawing interface layer that is accessed by applications in order to render drawings on a display, such as a monitor. The graphical drawing interface layer provides applications an application programming interface (API) for drawings and converts drawing requests by such applications into a set of drawing commands that it then provides to a video adapter driver. The video adapter driver, in turn, receives the drawing commands, translates them into video adapter specific drawing primitives and forwards them to a video adapter (e.g., graphics card, integrated video chipset, etc.). The video adapter receives the drawing primitives and immediately processes them, or alternatively, stores them in a First In First Out (FIFO) buffer for sequential execution, to update a framebuffer in the video adapter that is used to generate and transmit a video signal to a coupled external display. One example of such a graphical drawing interface layer is the Graphical Device Interface (GDI) of the Microsoft® Windows operating system (OS), which is implemented as a number of user-level and kernel-level dynamically linked libraries accessible through the Windows OS.

With the rise of technologies such as server based computing (SBC) and virtual desktop infrastructure (VDI), organizations are able to replace traditional personal computers (PCs) with instances of desktops that are hosted on remote desktop servers (or virtual machines running thereon) in a data center. A thin client application installed on a user's terminal connects to a remote desktop server that transmits a graphical user interface of an operating system session for rendering on the display of the user's terminal. One example of such a remote desktop server system is Virtual Computing Network (VNC) which utilizes the Remote Framebuffer (RFB) protocol to transmit framebuffers (which contain the values for every pixel to be displayed on a screen) from the remote desktop server to the client. In order to reduce the amount of display data relating to the graphical user interface that is transmitted to the thin client application, the remote desktop server may retain a second copy of the framebuffer that reflects a prior state of the framebuffer. This second copy enables the remote desktop server to compare a prior state and current state of the framebuffer in order to identify display data differences to encode (to reduce network transmission bandwidth) and subsequently transmit onto the network to the thin client application.

However, the computing overhead of copying the framebuffer to such a secondary framebuffer can significantly deteriorate performance of the remote desktop server. For example, to continually copy data from a framebuffer that supports a resolution of 1920×1200 and color depth of 24 bits per pixel to a secondary framebuffer at a rate of 60 times per second would require copying of over 3.09 Gb/s (gigabits per second).

SUMMARY

Display data is manipulated to reduce bandwidth requirements when transmitted to a remote client terminal. In one embodiment, a server has a primary framebuffer for storing display data and a display encoder that uses a secondary framebuffer for transmitting display data to a remote client terminal. A bounding box encompassing updates to display data in the primary framebuffer is identified and entries corresponding to the bounding box in a data structure are marked. Each entry of the data structure corresponds to a different region in the primary framebuffer and the marked entries further correspond to regions of the bounding box. Regions of the primary framebuffer are compared with corresponding regions of the secondary framebuffer and a trimmed data structure that contains marked entries only for compared regions having differences is published to the display encoder. In this manner, the display encoder is able to transmit updated display data of regions of the secondary framebuffer that correspond to marked entries in the trimmed data structure.

In one embodiment, the entries in the data structure are cleared after the publishing step to prepare for a subsequent transmission of display data to the remote terminal. In another embodiment, those regions for which the comparing step indicates differences are copied from the primary framebuffer into corresponding regions of the secondary framebuffer to provide the secondary framebuffer with updated display data.

DETAILED DESCRIPTION

Figure 1:
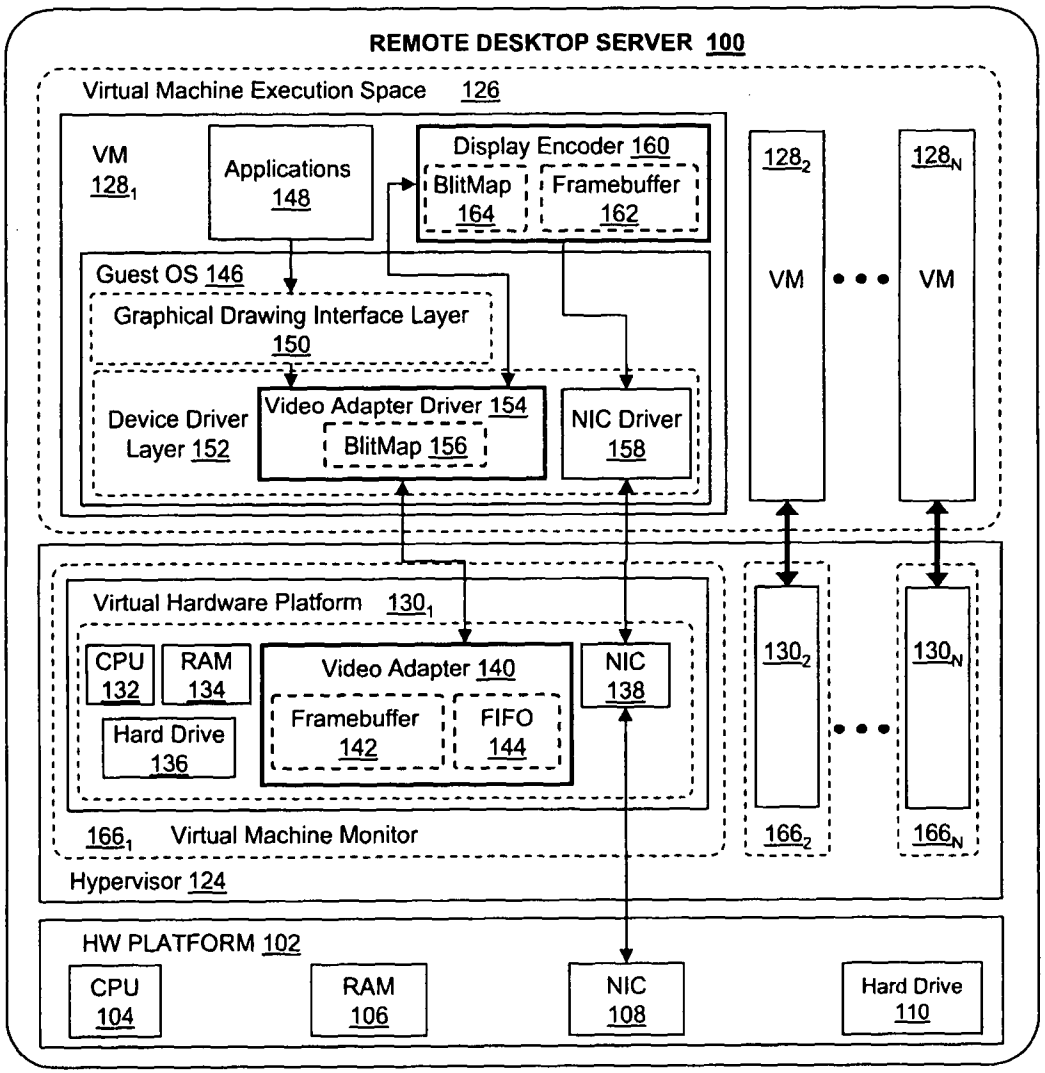
FIG. 1 depicts a block diagram of a remote desktop server, according to one embodiment of the invention.

FIG. 1 depicts a block diagram of a remote desktop server according to one or more embodiments of the invention. Remote desktop server 100 may be constructed on a desktop, laptop or server grade hardware platform 102 such as an x86 architecture platform. Such a hardware platform may include CPU 104, RAM 106, network adapter 108 (NIC 108), hard drive 110 and other I/O devices such as, for example and without limitation, a mouse and keyboard (not shown in FIG. 1).

A virtualization software layer, also referred to hereinafter as hypervisor 124, is installed on top of hardware platform 102. Hypervisor 124 supports virtual machine execution space 126 within which multiple virtual machines (VMs $128_1$-$128_N$) may be concurrently instantiated and executed. In one embodiment, each VM $128_1$-$128_N$ supports a different user who is remotely connected from a different client terminal. For each of VMs $128_1$-$128_N$, hypervisor 124 manages a corresponding virtual hardware platform (i.e., virtual hardware platforms $130_1$-$130_N$) that includes emulated hardware implemented in software such as CPU 132, RAM 134, hard drive 136, NIC 138 and video adapter 140. Emulated video adapter 140 allocates and maintains a framebuffer 142, which is a portion of memory used by video adapter 140 that holds a buffer of the pixel values from which a video display (i.e., "frame") is refreshed, and a First In First Out (FIFO) buffer 144, which is a portion of memory used by video adapter 140 that holds a list of drawing primitives that are used to update framebuffer 142. In one embodiment, FIFO buffer 144 is a shared memory buffer that is accessed and shared between video adapter 140 and video adapter driver 154.

Virtual hardware platform $130_1$ may function as an equivalent of a standard x86 hardware architecture such that any x86 supported operating system, e.g., Microsoft Windows®, Linux®, Solaris® x86, NetWare, FreeBSD, etc., may be installed as guest operating system (OS) 146 to execute applications 148 for an instantiated virtual machine, e.g., VM $128_1$. Applications 148 that require drawing on a display submit drawing requests through an API offered by graphical drawing interface layer 150 (e.g., Microsoft Windows® GDI, in one embodiment) which, in turn, converts the drawing requests into drawing commands and transmits the drawing commands to a video adapter driver 154 in device driver layer 152. As shown in the embodiment of FIG. 1, video adapter driver 154 allocates and maintains a spatial data structure 156, referred to hereinafter as a "blitmap" data structure that keeps track of potentially changed regions of framebuffer 142 of video adapter 140. Further details on the implementation and usage of blitmap data structures are detailed later in this Detailed Description. Device driver layer 152 includes additional device drivers such as NIC driver 158 that interact with emulated devices in virtual hardware platform $130_1$ (e.g., virtual NIC 138, etc.) as if such emulated devices were the actual physical devices of hardware platform 102. Hypervisor 124 is generally responsible for taking requests from device drivers in device driver layer 152 that are received by emulated devices in virtual platform $130_1$, and translating the requests into corresponding requests for real device drivers in a physical device driver layer of hypervisor 124 that communicates with real devices in hardware platform 102.

In order to transmit graphical user interfaces to the display of a remote client terminal, VM $128_1$ further includes a display encoder 160 that interacts with video adapter driver 154 (e.g., through an API) to obtain data from framebuffer 142 for encoding (e.g., to reduce network transmission bandwidth) and subsequent transmission onto the network through NIC driver 158 (e.g., through virtual NIC 138 and, ultimately, through physical NIC 108). Display encoder 160 allocates and maintains a secondary framebuffer 162 for storing data received from framebuffer 142 as well as its own blitmap data structure 164 (hereinafter, referred to as encoder blitmap data structure 164) for identifying changed regions in secondary framebuffer 162. In one embodiment, display encoder 160 continuously polls video adapter driver 154 (e.g., 30 or 60 times a second, for example) to copy changes made in framebuffer 142 to secondary framebuffer 162 to transmit to the remote client terminal.

Those with ordinary skill in the art will recognize that the various terms, layers and categorizations used to describe the virtualization components in FIG. 1 may be referred to differently without departing from their functionality or the spirit of the invention. For example, virtual hardware platforms $130_1$-$130_N$ may be considered to be part of virtual machine monitors (VMM) $166_1$-$166_N$ which implement the virtual system support needed to coordinate operations between hypervisor 124 and corresponding VMs $128_1$-$128_N$. Alternatively, virtual hardware platforms $130_1$-$130_N$ may also be considered to be separate from VMMs $166_1$-$166_N$, and VMMs $166_1$-$166_N$ may be considered to be separate from hypervisor 124. One example of hypervisor 124 that may be used in an embodiment of the invention is included as a component of VMware's ESX™ product, which is commercially available from VMware, Inc. of Palo Alto, Calif. It should further be recognized that embodiments of the invention may be practiced in other virtualized computer systems, such as hosted virtual machine systems, where the hypervisor is implemented on top of an operating system.

Figure 2:
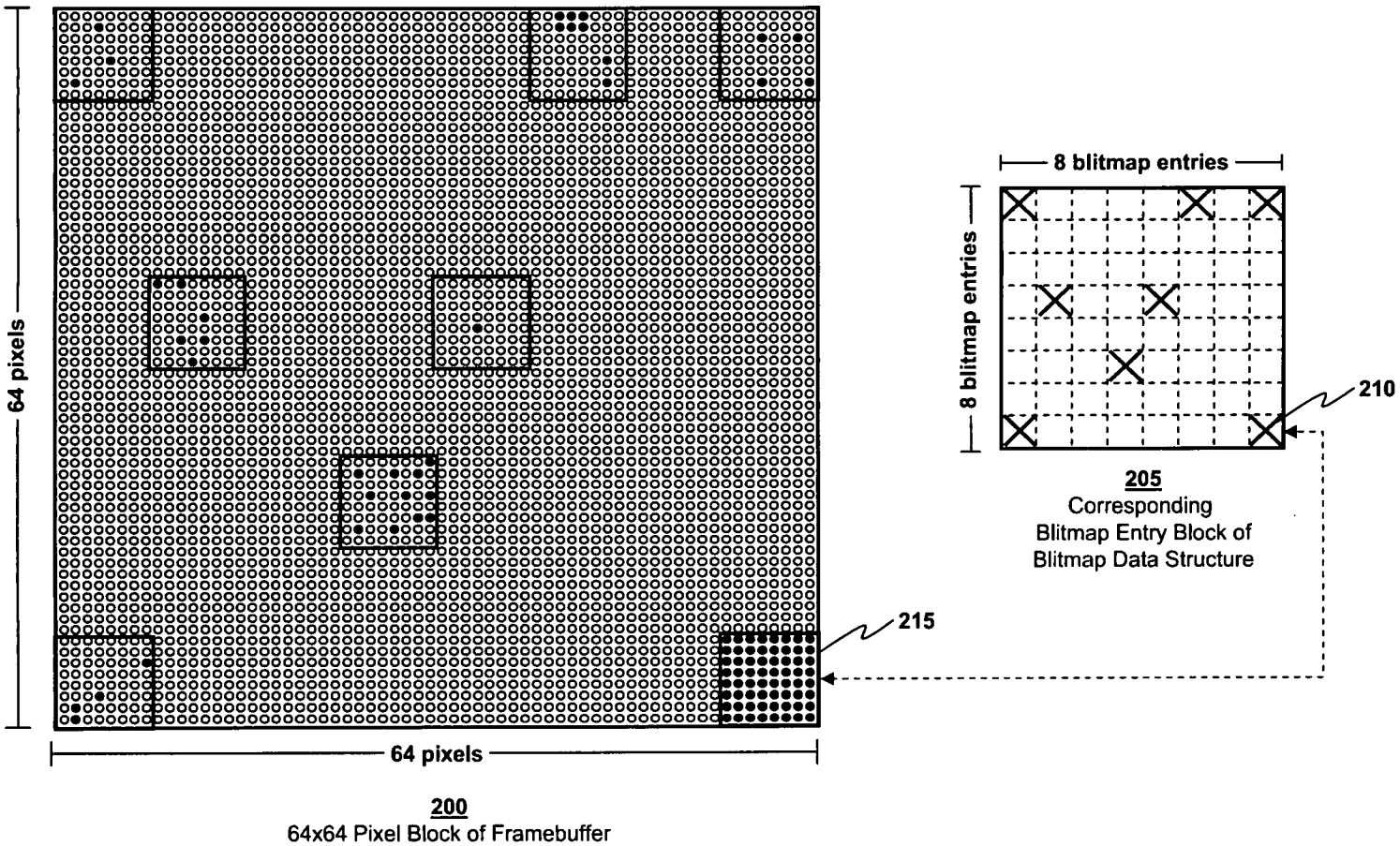
FIG. 2 depicts a "blitmap" data structure, according to one embodiment of the invention.

FIG. 2 depicts a blitmap data structure, according to one embodiment of the invention. Both video adapter driver 154 and display encoder 160 utilize a blitmap data structure to track changed regions of framebuffer 142 and secondary framebuffer 162, respectively. In the embodiment of FIG. 2, the blitmap data structure is a 2 dimensional bit vector where each bit (also referred to herein as a "blitmap entry") in the bit vector represents an N×N region of a corresponding framebuffer. A bit that is set (also referred to herein as a "marked" blitmap entry) in the bit vector indicates that at least one pixel value in the corresponding N×N region of the framebuffer has been changed during a particular interval of time (e.g., between polling requests by display encoder 160, for example). For example, FIG. 2 depicts a 64×64 pixel block 200 of a framebuffer where blackened dots represent pixel values that have changed during a particular interval of time. An 8×8 bit vector 205 represents a corresponding blitmap entry block of a blitmap data structure where each bit (or blitmap entry) corresponds to an 8×8 region in pixel block 200. A set bit (or marked blitmap entry) in bit vector 205 is represented by an "X." For example, marked blitmap entry 210 corresponds to framebuffer region 215 (all of whose pixel values have changed during a specified interval of time as indicated by the black dots). FIG. 2 illustrates other marked blitmap entries in bit vector 205 that correspond to regions in framebuffer pixel block 200 that have pixel values that have changed, as illustrated by blackened dots. By traversing a 2 dimensional bit vector embodiment of a blitmap data structure similar to 205 of FIG. 2, one can readily identify which N×N regions of a framebuffer have changed during a time interval (and also easily skip those regions that have not changed during the time interval).

Figure 3:
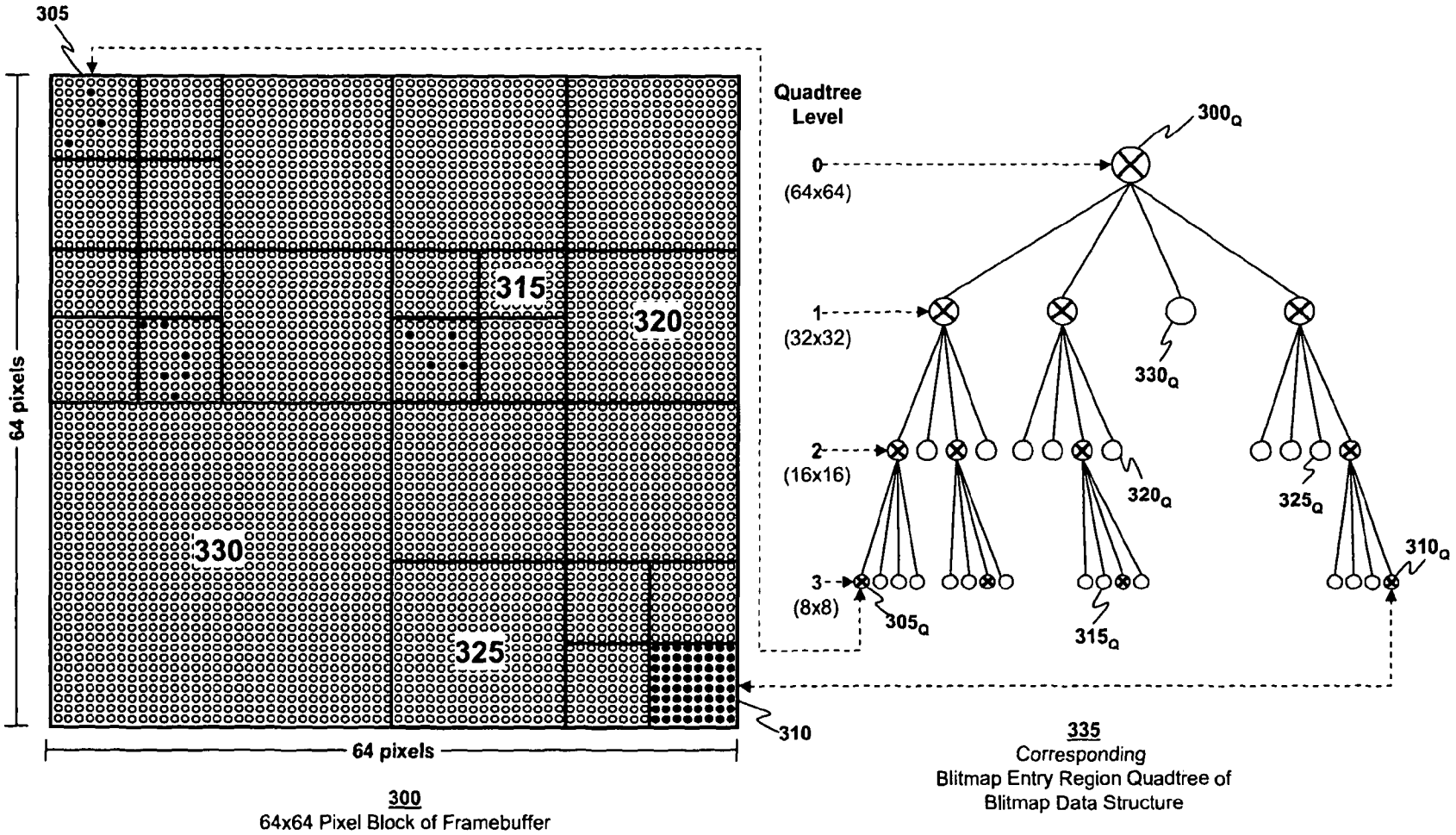
FIG. 3 depicts a second blitmap data structure, according to one embodiment of the invention.

FIG. 3 depicts a second blitmap data structure, according to one embodiment of the invention. In the embodiment of FIG. 3, the blitmap data structure is a region quadtree where each level of the tree represents a higher resolution bit vector of $2^N \times 2^N$ pixel blocks. FIG. 3 illustrates a 64×64 pixel block 300 of a framebuffer where blackened dots represent pixel values that have changed during a particular interval of time. A pixel block is successively subdivided into smaller and smaller sub-quadrants until each changed pixel (e.g., blackened dots) is contained within a smallest sub-quadrant. For example, in pixel block 300, the smallest sub-quadrant is an 8×8 pixel region, such as regions 305, 310 and 315. Larger sub-quadrants include 16×16 sub-quadrants, such as 320 and 325, as well as 32×32 sub-quadrants, such as 330. A four-level region quadtree 335 represents a blitmap data structure that corresponds to 64×64 pixel block 300 of the framebuffer. As depicted in FIG. 3, each level of region quadtree 335 can be implemented as a bit vector whose bits correspond to a sub-quadrant of a particular size in pixel block 300, ranging from 64×64 to 8×8, depending upon the level of the bit vector. A node in region quadtree 335 that is marked with an "X" indicates that at least one pixel value in the node's corresponding sub-quadrant in pixel block 300 has been changed during the particular interval of time (i.e., has a blackened dot). For example, node $\mathbf{300}_Q$ of level 0 (the 64×64 level) of region quadtree 335 represents the entirely of 64×64 pixel block and is marked with an "X" since at least one pixel value in pixel block 300 has changed. In contrast, node $\mathbf{330}_Q$ of level 1 (the 32×32 level) of region quadtree 335 represents 32×32 sub-quadrant 330 and is unmarked since no pixel values in sub-quadrant 330 have changed. Similarly, nodes $\mathbf{320}_Q$ and $\mathbf{325}_Q$ of level 2 (the 16×16 level) represent 16×16 sub-quadrants 320 and 325, respectively, and are unmarked since no pixel values in sub-quadrants 320 and 325 have changed. Nodes $\mathbf{305}_Q$, $\mathbf{310}_Q$ and $\mathbf{315}_Q$ of level 3 (the 8×8 level) correspond to 8×8 regions 305, 310 and 315 of pixel block 300, respectively, and are marked accordingly. In a region quadtree embodiment of a blitmap data structure, such as the embodiment of FIG. 3, each node in the deepest level of the region quadtree (i.e., corresponding to the smallest sub-quadrant, such as an 8×8 pixel region) is a blitmap entry. By traversing region quadtree embodiment of a blitmap data structure, one can readily identify which 8×8 regions (or other smallest sized sub-quadrant) of a framebuffer have changed during a time interval. Furthermore, due to its tree structure, one can also quickly skip large sized sub-quadrants in the framebuffer that have not changed during the time interval. It should further be recognized that a region quadtree embodiment of a blitmap data structure may further conserve memory used by the blitmap data structure, depending upon the particular implementation of the region quadtree. For example, while the 2 dimensional bit vector embodiment of a blitmap data structure 205 of FIG. 2, consumes 64 bits no matter how many 8×8 regions may be unmarked, region quadtree 335 of FIG. 3 consumes fewer bits when fewer 8×8 regions are marked. As depicted, the implementation of blitmap data structure 205 utilizes 64 bits while blitmap data structure 335 utilizes 33 bits. It should be recognized that encoder blitmap data structure 164 and driver blitmap data structure 156 may each be implemented using a variety of different data structures, including those of FIGS. 2 and 3, and that in any particular embodiment, encoder blitmap data structure 164 may use a different data structure than driver blitmap data structure 156.

Figure 4:
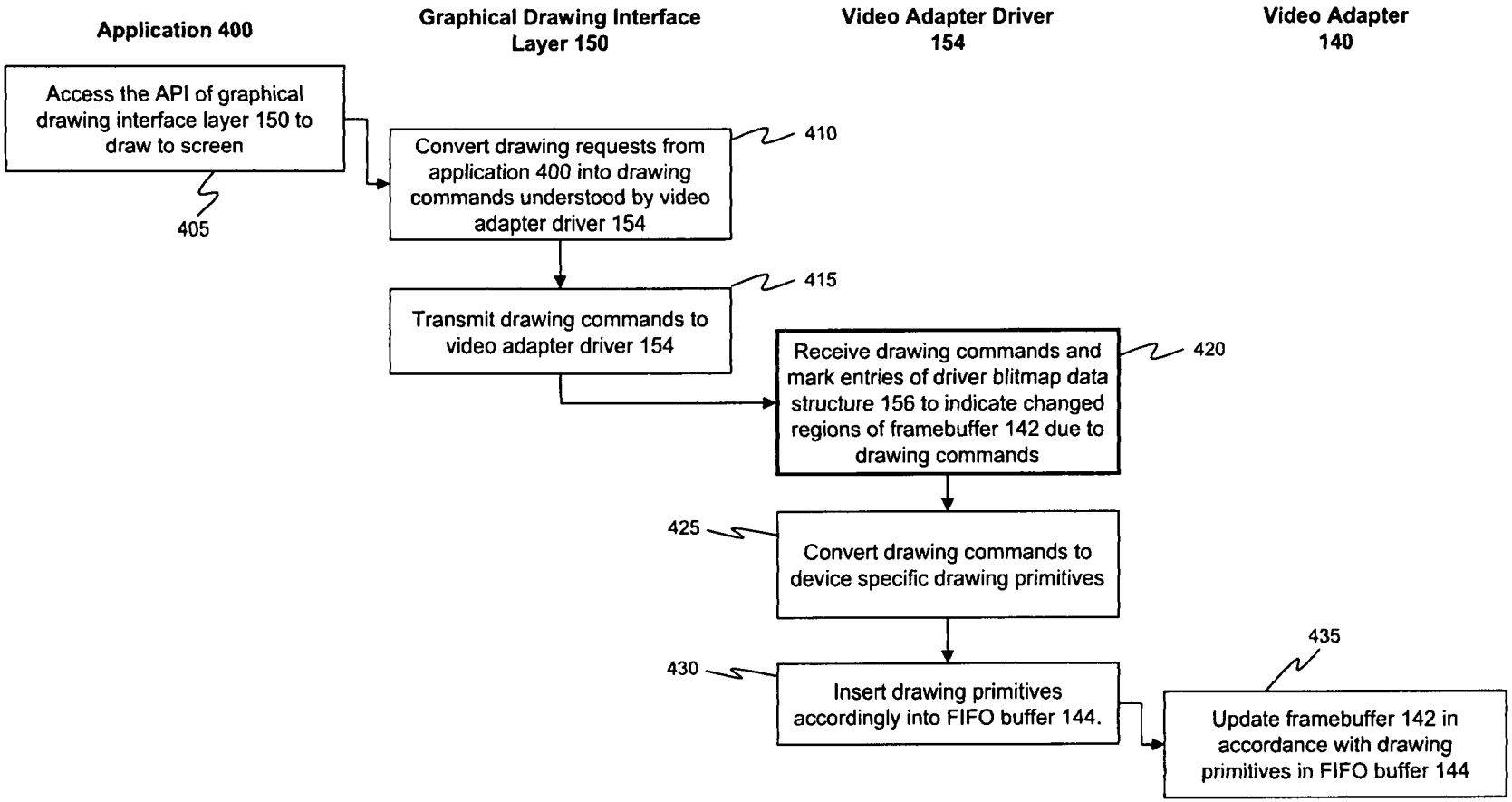
FIG. 4 is a flow diagram depicting steps to transmit drawing requests from an application to a video adapter, according to one embodiment of the invention.

FIG. 4 is a flow diagram depicting steps to transmit drawing requests from an application to a video adapter, according to one embodiment of the invention. Although the steps are described with reference to the components of remote desktop server 100 in FIG. 1, it should be recognized that any system configured to perform the steps, in any order, is consistent with the present invention.

According to the embodiment of FIG. 4, in step 405, during its execution, application 400 (i.e., one of applications 148 running on guest OS 146) accesses the API of graphical drawing interface layer 150 (e.g., GDI in Microsoft Windows) to submit drawing requests to a screen, for example, to update its graphical user interface in response to a user action. In step 410, through guest OS 146, graphical drawing interface layer 150 receives the drawing requests and converts them into drawing commands that are understood by video adapter driver 154. In step 415, graphical drawing interface layer 150 transmits the drawing commands to video adapter driver 154. In step 420, video adapter driver 154 receives the drawing commands and marks entries of driver blitmap data structure 156 to indicate that at least a portion of pixel values in regions of framebuffer 142 corresponding to the marked entries of driver blitmap data structure 156 will be updated as a result of executing the drawing commands. In one embodiment, video adapter driver 154 calculates or otherwise determines an area within framebuffer 142, such as a rectangle of minimum size that encompasses the pixels that will be updated as a result of executing the drawing commands (i.e., also referred to as a "bounding box"). Video adapter driver 154 is then able to identify and mark all blitmap entries in driver blitmap data structure 156 corresponding to regions of framebuffer 154 that include pixel values in the determined area. In step 425, video adapter driver 154 converts the drawing commands to device specific drawing primitives and, in step 430, inserts the drawing primitives into FIFO buffer 144 (e.g., in an embodiment where FIFO buffer 144 is shared between video adapter driver 154 and video adapter 140). In step 435, video adapter 140 can then ultimately update framebuffer 142 in accordance with the drawing primitives when they are ready to be acted upon (i.e., when such drawing primitives reach the end of FIFO buffer 144).

Figure 5:
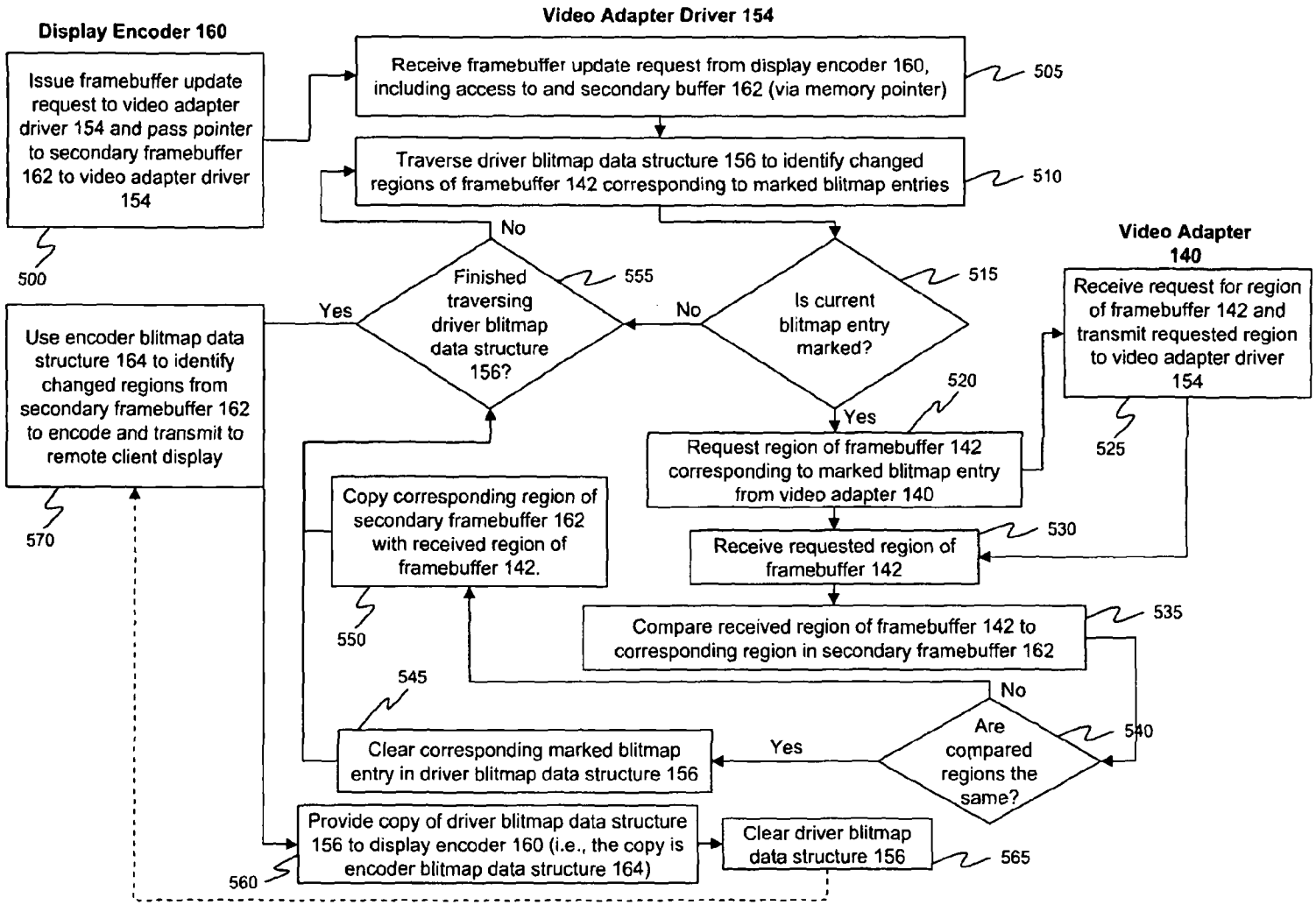
FIG. 5 is a flow diagram depicting steps to transmit framebuffer data from a video adapter to a display encoder, according to one embodiment of the invention.

FIG. 5 is a flow diagram depicting steps to transmit framebuffer data from a video adapter to a display encoder, according to one embodiment of the invention. Although the steps are described with reference to the components of remote desktop server 100 in FIG. 1, it should be recognized that any system configured to perform the steps, in any order, is consistent with the present invention.

According to the embodiment of FIG. 5, display encoder 160 is a process running on guest OS 146 which continually polls (e.g., 30 or 60 times a second, for example) video adapter driver 154 to obtain data in framebuffer 142 of video adapter 140 to encode and transmit onto the network (e.g., through NIC driver 158) for receipt by a remote client terminal. In step 500, display encoder 160, via an API routine exposed to it by video adapter driver 154, issues a framebuffer update request to video adapter driver 154 and passes to video adapter driver 154 a memory reference (e.g., pointer) to secondary framebuffer 162 to enable video adapter driver 154 to directly modify secondary framebuffer 162. In step 505, video adapter driver 154 receives the framebuffer update request and, in step 510, it traverses its driver blitmap data structure 156 to identify marked blitmap entries that correspond to regions of framebuffer 142 that have changed since the previous framebuffer update request from display encoder 160 (due to drawing requests from applications as described in FIG. 4). If, in step 515, a current blitmap entry is marked, then, in step 520, video adapter driver 154 requests the corresponding region (i.e., the pixel values in the region) of framebuffer 142 from video adapter 140. In step 525, video adapter 140 receives the request and transmits the requested region of framebuffer 142 to video adapter driver 154.

In step 530, video adapter driver 154 receives the requested region of framebuffer 142 and, in step 535, compares the pixel values in the received requested region of framebuffer 142 to the pixel values of the corresponding region in secondary framebuffer 162, which reflects a previous state of the framebuffer 142 upon completion of the response of video adapter driver 154 to the previous framebuffer update request from display encoder 160. This comparison step 535 enables video adapter driver 154 to identify possible inefficiencies resulting from visually redundant transmissions of drawing requests by applications as described in FIG. 4. For example, perhaps due a lack of focus on optimizing drawing related aspects of their functionality, some applications may issue drawing requests in step 405 of FIG. 4 that redundantly redraw their entire graphical user interface even if only a small region of the graphical user interface was actually modified by the application. Such drawing requests cause entries in driver blitmap data structure 156 to be marked in step 420 of FIG. 4 even if the corresponding framebuffer 142 regions of the marked blitmap entries need not be updated with new pixel values (i.e., the regions correspond to parts of the graphical user interface that are not actually modified). With such marked blitmap entries, comparison step 535 will reveal that the regions of framebuffer 142 and secondary framebuffer 162 corresponding to the marked blitmap entries are the same since the pixel values of such regions did not change due to un-optimized drawing requests submitted by applications (in step 405) after completion of video adapter driver's 154 response to the previous framebuffer update request from display encoder 160.

As such, in step 540, if comparison step 535 indicates that the regions of framebuffer 142 and secondary framebuffer 162 are the same, then in step 545, video adapter driver 154 "trims" driver blitmap data structure 156 by clearing the marked blitmap entry to indicate that no actual pixel values were changed in the corresponding region of framebuffer 142 since completion of video adapter driver's 154 response to the previous framebuffer update request from display encoder 160.

Figure 6:
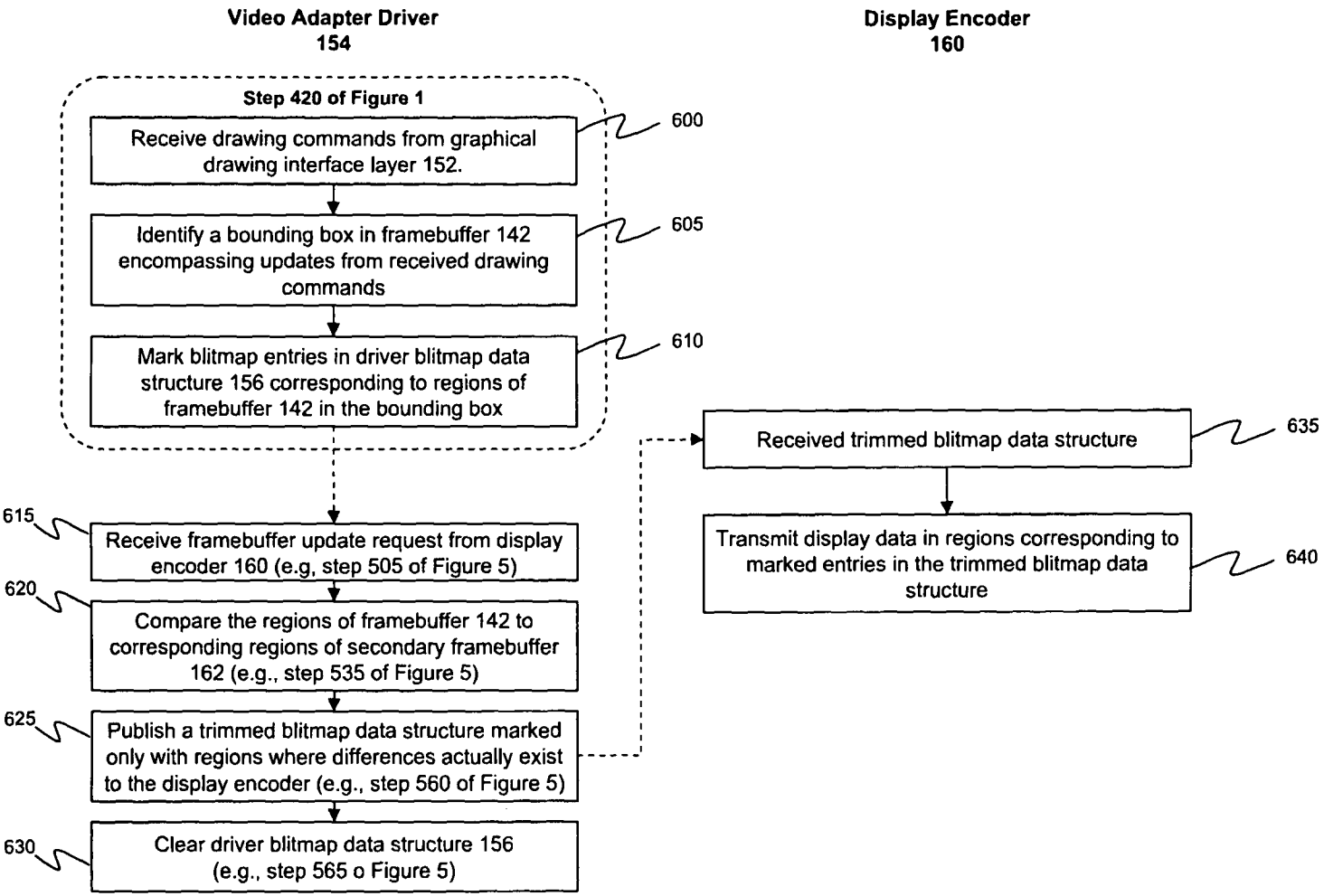
FIG. 6 is a flow diagram depicting steps to trim a blitmap data structure, according to one embodiment of the invention.

FIG. 6 is a flow diagram depicting steps to trim a blitmap data structure, according to one embodiment of the invention. Although the steps are described with reference to the components of remote desktop server 100 in FIG. 1, it should be recognized that a system may be configured to perform like steps, in a different order.

In step 600, video adapter driver 154 receives drawing commands from graphical drawing interface layer 150 and in step 605, identifies a bounding box in framebuffer 142 that encompasses all the pixel value updates resulting from executing the drawing commands. In step 610, video adapter driver 154 marks the blitmap entries in driver blitmap data structure 156 that correspond to regions of framebuffer 142 that are in (or portions of the regions are in) the bounding box. It should be recognized that steps 605 through 610 correspond to sub-steps that make up step 420 of FIG. 4. When a framebuffer update request is received from display encoder in step 615, video adapter driver 154 compares the regions of framebuffer 142 in the bounding box (as indicated by marked blitmap entries in driver blitmap data structure 156) to corresponding regions in secondary framebuffer 164 (which contains the state of framebuffer 142 upon completion of video adapter driver's 154 response to the immediately prior framebuffer update request) in step 620. In step 625, video adapter driver 154 publishes to display encoder 160 a trimmed blitmap data structure whose only marked entries correspond to compared regions in step 620 where differences actually exist. In step 630, video adapter driver 154 clears driver blitmap data structure 154 of all marked entries. It should be recognized that steps 615 through 630 generally correspond to steps 505, 535, 560 and 565 of FIG. 5, respectively. In step 635, display encoder 160 receives the trimmed blitmap data structure and, in step 640, it transmits display data in regions corresponding to marked entries in the trimmed blitmap data structure.

Figure 7:
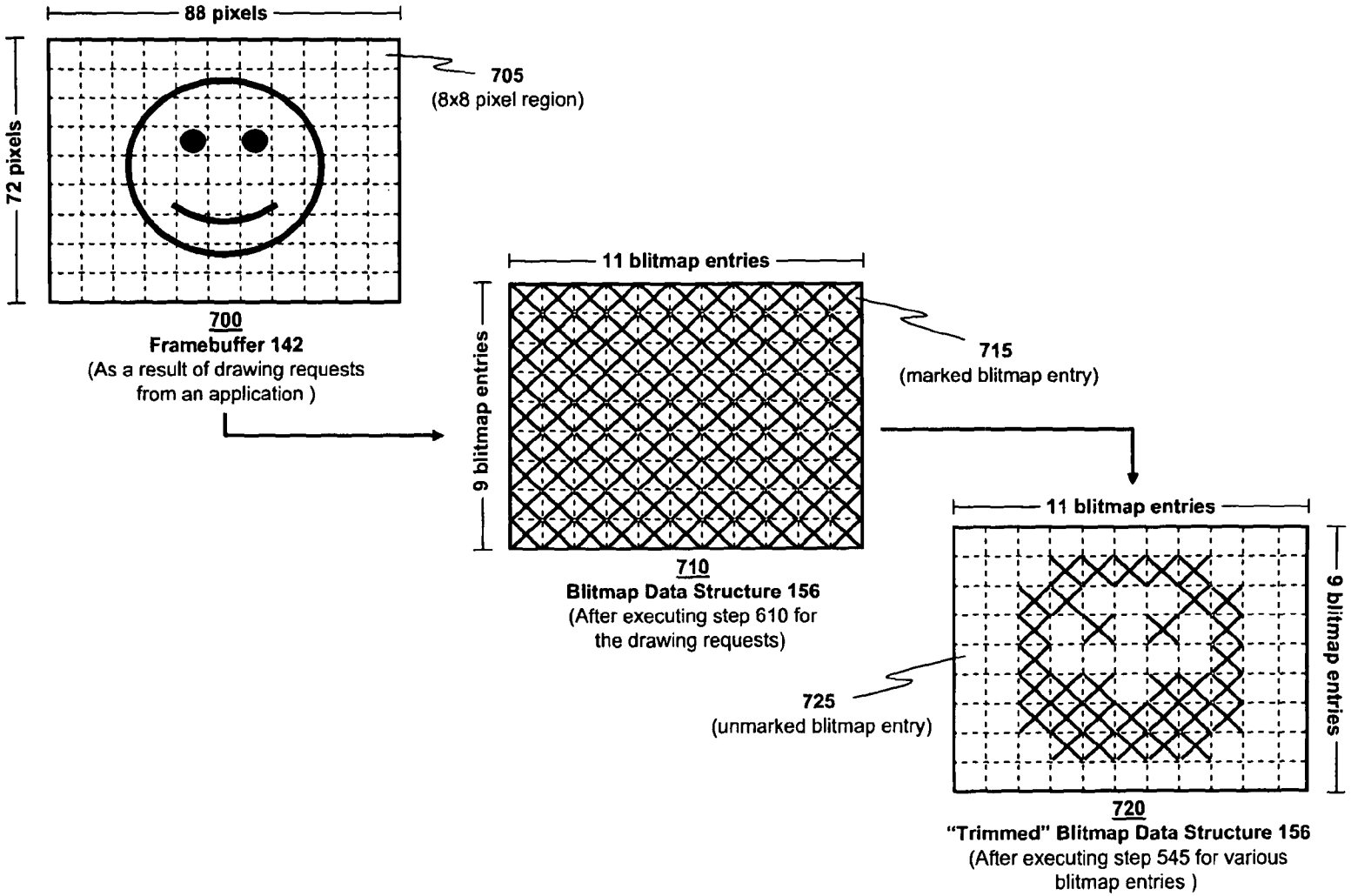
FIG. 7 depicts a visual example of trimming a blitmap data structure, according to one embodiment of the invention.

FIG. 7 depicts a visual example of trimming a blitmap data structure. FIG. 7 illustrates a 88×72 pixel block 700 of framebuffer 142. Each subdivided block, such as 705, represents an 8×8 pixel region that corresponds to a blitmap entry in driver blitmap data structure 156. As depicted in FIG. 7, pursuant to step 600 of FIG. 6, video adapter driver 154 has received drawing commands relating to an application's drawing requests in order to draw a smiley face as depicted in pixel block 700. However, the drawing commands inefficiently request that the entirety of pixel block 700 gets redrawn, rather than just requesting the drawing of the specific pixels of the smiley face itself. As such, each of the blitmap entries in a corresponding 11×9 blitmap block 710 of driver blitmap data structure 156 are marked by video adapter driver 154 pursuant to step 610 of FIG. 6 (such as marked blitmap entry 715). However, when video adapter driver 154 receives a framebuffer update request from display encoder 160, as in step 615, video adapter driver 154 is able to trim blitmap block 710, thereby creating blitmap block 720, and publish blitmap block 710 to display encoder 160 in steps 620 and 625, for example, by clearing blitmap entries, such as unmarked blitmap entry 725, whose corresponding regions in framebuffer 142 were not actually changed (i.e., did not contain a smiley face modified pixel) as in step 545 of FIG. 5.

Returning to FIG. 5, if, however, in step 540, the comparison step 535 indicates that the regions of framebuffer 142 and secondary framebuffer 162 are different (i.e., actual pixel values in the region of framebuffer 142 have changed as a result of drawing requests of applications in step 405 since completing the response to the previous framebuffer update request from display encoder 160), then in step 550, video adapter driver 154 copies the pixel values in the region of framebuffer 142 to the corresponding region of secondary framebuffer 162 to properly reflect in secondary framebuffer 162 the changed pixel values in the region of framebuffer 142. In step 555, if video adapter driver 154 has not completed traversing driver blitmap data structure 156, the flow returns to step 510. If, in step 555, video adapter driver 154 has completed traversing driver blitmap data structure 156, then in step 560, video adapter driver 154 provides a copy of driver blitmap data structure 156 to display encoder 160, which becomes and is referred to herein as encoder blitmap data structure 164. To the extent that marked blitmap entries were cleared in driver blitmap data structure 156 in step 545, encoder blitmap data structure 164 reflects a more optimized view of regions in secondary framebuffer 162 that have actual changed pixel values. In step 565, video adapter driver 154 clears all the marked blitmap entries in driver blitmap data structure 156 in preparation for receiving a subsequent framebuffer update request from display encoder 160 and indicates to display encoder 160 that it has completed its response to the framebuffer update request issued in step 500.

Upon completion of video adapter driver's 154 response to framebuffer update request issued by display encoder 160 in step 500, secondary framebuffer 162 contains all changed pixel values resulting from drawing requests from applications (from step 405 of FIG. 4) since the completed response to the previous framebuffer update request from display encoder 160 and encoder blitmap data structure 164 contains marked blitmap entries that indicate which regions within secondary framebuffer 162 contain such changed pixel values. With such information, in step 570, display encoder 160 can traverse encoder blitmap data structure 164 for marked blitmap entries and extract only those regions in secondary framebuffer 162 that correspond to such marked blitmap entries for encoding and transmission to a remote client display.

Although FIG. 1 depicts an embodiment where display encoder 160 executes within virtual machine $\mathbf{128}_1$, it should be recognized that alternative embodiments may implement display encoder 160 in other components of remote desktop server 100, for example, within the virtual machine monitor $\mathbf{166}_1$ or elsewhere in hypervisor 124. Similarly, although FIG. 1 depicts an embodiment where display encoder 160 and video adapter driver 154 run in a virtual machine $\mathbf{128}_1$ that communicates with a virtual video adapter 140 in a hypervisor 124, it should be recognized that these components may be deployed in any remote desktop server architecture, including non-virtual machine based computing architectures. Furthermore, rather than having display encoder 160 and virtual video adapter 140 as software components of the server, alternative embodiments may utilize hardware components for each or either of them. Similarly, it should be recognized that alternative embodiments may not require any virtual video adapter. Instead, in such alternative embodiments, for example, video adapter driver 154 may allocate and manage framebuffer 142 and FIFO buffer 144 itself. Similarly, in alternative embodiments, video adapter 140 may not have a FIFO buffer such as FIFO buffer 140, but may immediately process incoming drawing primitives upon receipt. It should be similarly recognized that various other data structures and buffers described herein can be allocated and maintained by alternative system components. For example, rather than having display encoder 160 allocate and maintain secondary framebuffer 162 and pass a memory reference to video adapter driver 154 as detailed in step 500 of FIG. 5, video adapter driver 154 may allocate and maintain secondary framebuffer 162 (as well as encoder blitmap data structure 164) and provide memory reference access to display encoder 160 in an alternative embodiment. Additionally, it should be recognized that some of the functionality and steps performed by video adapter driver 154 as described herein can be implemented in a separate extension or component to a pre-existing or standard video adapter driver (i.e., display encoder 160 may communicate with such a separate extension to the video adapter driver rather than the pre-existing video adapter driver itself). Similarly, it should be recognized that alternative embodiments may vary the amount and types of data exchanged between system components as described herein or utilize various optimization techniques. For example, rather than copying and providing all of driver blitmap data structure 156 as encoder blitmap data structure 164 in step 560 of FIG. 5, an alternative embodiment may provide only relevant portions of driver blitmap data structure 156 to display encoder 160 or otherwise utilize an alternative data structure to provide such relevant portions of driver blitmap data structure 156 to display encoder 160. Similarly, it should be recognized that caching techniques may be utilized to optimize portions of the teachings herein. For example, video adapter driver 154 may maintain an intermediate cache of FIFO buffer 144 to reduce computing overhead, for example, during step 420 of FIG. 4. Similarly, rather than (or in addition to) continuously polling video adapter driver 154, in alternative embodiments, display encoder 160 may receive callbacks or interrupts initiated by video adapter driver 154 when framebuffer 142 updates its contents and/or additionally receive framebuffer update requests from the remote client.

The various embodiments described herein may employ various computer-implemented operations involving data stored in computer systems. For example, these operations may require physical manipulation of physical quantities usually, though not necessarily, these quantities may take the form of electrical or magnetic signals where they, or representations of them, are capable of being stored, transferred, combined, compared, or otherwise manipulated. Further, such manipulations are often referred to in terms, such as producing, identifying, determining, or comparing. Any operations described herein that form part of one or more embodiments of the invention may be useful machine operations. In addition, one or more embodiments of the invention also relate to a device or an apparatus for performing these operations. The apparatus may be specially constructed for specific required purposes, or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

The various embodiments described herein may be practiced with other computer system configurations including hand-held devices, microprocessor systems, microprocessor-based or programmable consumer electronics, minicomputers, mainframe computers, and the like.

One or more embodiments of the present invention may be implemented as one or more computer programs or as one or more computer program modules embodied in one or more computer readable media. The term computer readable medium refers to any data storage device that can store data which can thereafter be input to a computer system computer readable media may be based on any existing or subsequently developed technology for embodying computer programs in a manner that enables them to be read by a computer. Examples of a computer readable medium include a hard drive, network attached storage (NAS), read-only memory, random-access memory (e.g., a flash memory device), a CD (Compact Discs) CD-ROM, a CD-R, or a CD-RW, a DVD (Digital Versatile Disc), a magnetic tape, and other optical and non-optical data storage devices. The computer readable medium can also be distributed over a network coupled computer system so that the computer readable code is stored and executed in a distributed fashion.

Although one or more embodiments of the present invention have been described in some detail for clarity of understanding, it will be apparent that certain changes and modifications may be made within the scope of the claims. Accordingly, the described embodiments are to be considered as illustrative and not restrictive, and the scope of the claims is not to be limited to details given herein, but may be modified within the scope and equivalents of the claims. In the claims, elements and/or steps do not imply any particular order of operation, unless explicitly stated in the claims.

In addition, while described virtualization methods have generally assumed that virtual machines present interfaces consistent with a particular hardware system, persons of ordinary skill in the art will recognize that the methods described may be used in conjunction with virtualizations that do not correspond directly to any particular hardware system. Virtualization systems in accordance with the various embodiments, implemented as hosted embodiments, non-hosted embodiments, or as embodiments that tend to blur distinctions between the two, are all envisioned. Furthermore, various virtualization operations may be wholly or partially implemented in hardware. For example, a hardware implementation may employ a look-up table for modification of storage access requests to secure non-disk data.

Many variations, modifications, additions, and improvements are possible, regardless of the degree of virtualization. The virtualization software can therefore include components of a host, console, or guest operating system that performs virtualization functions. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in exemplary configurations may be implemented as a combined structure or component. Similarly, structures and functionality presented as a single component may be implemented as separate components. These and other variations, modifications, additions, and improvements may fall within the scope of the appended claims(s).

We claim:

1. In a server having a primary framebuffer for storing display data and a display encoder that uses a secondary framebuffer for transmitting display data to a remote client terminal, a method for preparing display data to be transmitted to the remote client terminal, the method comprising:

identifying a bounding box according to drawing commands that cause updates to display data in-the primary framebuffer, the bounding box enclosing a portion of the primary framebuffer to which the drawing commands are directed;

marking entries in a data structure, wherein each entry of the data structure corresponds to a different region in the primary framebuffer and the marked entries further correspond the portion of the primary framebuffer;

comparing regions of the primary framebuffer corresponding to the marked entries with corresponding regions of the secondary framebuffer, wherein the secondary framebuffer contains display data reflecting a state of the primary framebuffer prior to the updates caused by the drawing commands; and publishing to the display encoder a trimmed data structure containing marked entries only for compared regions having differences, so that the display encoder is able to transmit updated display data of regions of the secondary framebuffer that correspond to marked entries in the trimmed data structure.

2. The method of claim 1, further comprising the step of clearing the entries in the data structure after the publishing step.

3. The method of claim 1, further comprising the step of copying regions for which the comparing step indicates the differences from the primary framebuffer into corresponding regions of the secondary framebuffer.

4. The method of claim 1, wherein the primary framebuffer is a memory buffer allocated by a virtual video adapter and the data structure is allocated by a video adapter driver that communicates with the virtual video adapter.

5. The method of claim 4, wherein the video adapter driver is a component of a guest operating system of a virtual machine instantiated on the server.

6. The method of claim 1, wherein the data structure is a two dimensional bit vector.

7. The method of claim 1, wherein the data structure is a region quadtree.

8. A non-transitory computer-readable medium including instructions that, when executed by a processing unit of a server having a primary framebuffer for storing display data and a display encoder that uses a secondary framebuffer for transmitting display data to a remote client terminal, causes the processing unit to prepare display data to be transmitted to the remote client terminal, by performing the steps of:

identifying a bounding box according to drawing commands that cause updates to display data in the primary framebuffer, the bounding box enclosing a portion of the primary framebuffer to which the drawing commands are directed;

marking entries in a data structure, wherein each entry of the data structure corresponds to a different region in the primary framebuffer and the marked entries further correspond the portion of the primary framebuffer;

comparing regions of the primary framebuffer corresponding to the marked entries with corresponding regions of the secondary framebuffer, wherein the secondary frame buffer contains display data reflecting a state of the primary framebuffer prior to the updates caused by the drawing commands; and publishing to the display encoder a trimmed data structure containing marked entries only for compared regions having differences, so that the display encoder is able to transmit updated display data of regions of the secondary framebuffer that correspond to marked entries in the trimmed data structure.

9. The non-transitory computer-readable medium of claim 8, wherein the processing unit further performs the step of clearing the entries in the data structure after the publishing step.

10. The non-transitory computer-readable medium of claim 8, wherein the processing unit further performs the step of copying regions for which the comparing step indicates the differences from the primary framebuffer into corresponding regions of the secondary framebuffer.

11. The non-transitory computer-readable medium of claim 8, wherein the primary framebuffer is a memory buffer allocated by a virtual video adapter and the data structure is allocated by a video adapter driver that communicates with the virtual video adapter.

12. The non-transitory computer-readable medium of claim 11, wherein the video adapter driver is a component of a guest operating system of a virtual machine instantiated on the server.

13. The non-transitory computer-readable medium of claim 8, wherein the data structure is a two dimensional bit vector.

14. The non-transitory computer-readable medium of claim 8, wherein the data structure is a region quadtree.

15. In a server having a primary framebuffer for storing display data and a display encoder that uses a secondary framebuffer for transmitting display data to a remote client terminal, a method for preparing display data to be transmitted to the remote client terminal, the method comprising:

receiving a request from the display encoder to update the secondary framebuffer, wherein the secondary frame buffer contains display data reflecting a state of the primary framebuffer prior to updates to display data in the primary framebuffer caused by drawing commands;

identifying marked entries in a spatial data structure to locate regions of the primary framebuffer that contain the updates to the display data, wherein each entry of the spatial data structure corresponds to a different region of the primary framebuffer;

copying display data from located regions of the primary framebuffer to corresponding regions in the secondary framebuffer; and clearing the marked entries in the spatial data structure, corresponding to regions of the primary framebuffer that was identical to corresponding regions of the secondary framebuffer prior to the copying, so that the display encoder is able to transmit updated display data of only those regions of the secondary framebuffer that correspond to marked entries in the spatial data structure and therefore contain changed data.

16. The method of claim 15, wherein, prior to the copying step, the secondary framebuffer contains display data reflecting a prior state of the primary framebuffer upon a completion of a response to a prior request from the display encoder to update the secondary framebuffer.

17. The method of claim 15, further comprising the steps of:

receiving drawing commands corresponding to drawing requests made by an application running on the server;

determining an area of the primary framebuffer to be updated as a result of executing the drawing commands; and marking all entries in the spatial data structure corresponding to regions of the primary framebuffer that include display data in the determined area.

18. The method of claim 17, wherein the determined area is a rectangle that bounds all display data in the primary framebuffer to be updated as a result of executing the drawing commands.

19. The method of claim 15, further comprising the step of providing a copy of the spatial data structure to the display encoder prior to the clearing step, wherein the display encoder transmits display data residing in regions of the secondary framebuffer corresponding to marked entries in the copy of the spatial data structure.

20. The method of claim 19, further comprising the steps of:

prior to the copying step, comparing the located regions of the primary framebuffer to matching regions of the secondary framebuffer; and clearing each of the marked entries in the spatial data structure corresponding to located regions of the primary framebuffer that contain the same display data as the corresponding matching regions of the secondary framebuffer.

* * * * *